US006233426B1

(12) United States Patent
Lee et al.

(10) Patent No.: US 6,233,426 B1
(45) Date of Patent: May 15, 2001

(54) COVER ASSEMBLY FOR AN IMAGE PROCESSING SYSTEM

(75) Inventors: Jerring Lee; Danny Chang, both of Hsin-Chu (TW)

(73) Assignee: Mustek Systems Inc. (TW)

( * ) Notice: Subject to any disclaimer, the term of this patent is extended or adjusted under 35 U.S.C. 154(b) by 0 days.

(21) Appl. No.: 09/246,694

(22) Filed: Feb. 9, 1999

(51) Int. Cl.[7] ..... G03G 15/00
(52) U.S. Cl. ..... 399/380; 355/75
(58) Field of Search ..... 399/379, 380, 399/377, 362, 107; 358/401, 406, 474; 355/75

(56) References Cited

U.S. PATENT DOCUMENTS 5,541,712 * 7/1996 Fujitaka et al. ..... 399/380
5,812,285 * 9/1998 Lin et al. ..... 355/75 X
6,006,064 * 12/1999 Hashimoto ..... 399/380

FOREIGN PATENT DOCUMENTS 6-332282 * 12/1994 (JP) .

* cited by examiner

*Primary Examiner*—Sophia S. Chen

(57) ABSTRACT

A cover assembly having a cover member and a plurality of articulated links is disclosed. One end of each link is pivotally mounted to a recessed region of a housing body and an opposed end of the link is pivotally mounted to extending legs of the rigid cover member. Articulated movement of the cover assembly enables the cover member to assume a substantially parallel disposition relative the platen regardless of the thickness of document. Another feature of the invention allows the rigid cover to remain substantially vertical in its fully raised position. The engagement of top portions of the links and flat areas on rear wall of the cover member between the extending legs stops the cover from pivoting towards the backs of the links.

12 Claims, 9 Drawing Sheets

COVER ASSEMBLY FOR AN IMAGE PROCESSING SYSTEM

FIELD OF THE INVENTION

This invention relates to a cover assembly and in particular relates to an articulated cover assembly for an image processing system.

DESCRIPTION OF THE PRIOR ART

An image processing system comprises scanning and copying apparatuses. The scanning apparatus, such as a scanner, is becoming increasingly popular among the computer peripheral equipment in recent years. The scanner includes an image pick-up device, a feed-in device, and a driving device. The image pick-up device usually takes a contact image sensor (CIS) which includes a light source, and the intensity of light source is not great, thus how to prevent the light from escaping in order to get the better image is an important problem.

The type of cover assembly has a close relationship to this problem. It has been found that if the cover assembly of scanner can be made to remain parallel with the platen surface regardless of the thickness of the document to be scanned, the most effective position for preventing the light from escaping is provided.

When the document is thin, almost all cover members of various cover assembly types lie flat against the platen to prevent the light from escaping. Referring to FIG. 1A and FIG. 1B, when the thin document is replaced by a thick document 2 such as a book, the cover assembly 4 which is hinged with only one pivot along an edge cannot be moved to remain parallel with the platen, allowing the reflected light from the cover assembly 4 to escape, the thickness of the document 2 preventing such disposition.

FIG.2 shows the other type of the cover assembly. The cover assembly 6 comprising a rigid cover member 8 and a support portion 10. The rigid cover member 8 can pivot about a hinging means 12. The support portion 10 incorporating a plurality of rods 14 is vertically slidingly engaged within holes 16 formed in the scanner housing 18. Accommodation of various document thickness is provided by vertical sliding movement of the support portion 10. Although the cover assembly 6 can accommodate any thickness of the document, friction between the rods 14 and the holes 16 hinders the vertical sliding movement of the support portion 10.

It is, therefore, important to provide a cover assembly that can accommodate various thickness of documents ranging from a signal sheet to a thick book and can be operated easily.

The cover assembly also can be applied to the copying apparatus, such as a copier, usually has a higher energy exposure source for improving the quality of copies made from a given original. The higher energy exposure source will emit higher levels of ultraviolet or visible radiation. The cover assembly can provide adequate protection for the user's eyes in order to avoid the possibility of harmful effects resulting from the radiation.

SUMMARY OF THE INVENTION

The present invention provides a low cost, few elements, and easily operated rigid cover assembly. The elements included in the cover assembly are easy to connect.

The cover assembly in the present invention can be made to remain parallel with a platen surface regardless of the thickness of the document.

In one embodiment, a rigid cover member is pivotally mounted on extending legs thereof to two links that in turn are pivotally mounted to two recessed regions. The recessed regions formed on a projecting region of housing body in an image processing system.

The engagement of two top portions of two links and two flat areas on a rear wall of the rigid cover member stops the cover member from pivoting toward the back of the link.

The pivoting links allow the cover member to remain substantially parallel with the platen regardless of the thickness of the document to be scanned or copied, thereby preventing the light escaping or the radiation reaching the user's eyes.

As the cover member assumes a parallel disposition relative to the platen, a starter will be detected by a starting device included in the housing body and the image processing system has to get ready for image processing.

In an alternate embodiment, one end of each link that has a first rib is pivotally mounted to a recessed region of a housing body and an opposed edge of the link is pivotally mounted to extending legs of a main lid that has a second rib. The links and the main lid rotate together for covering a thin document and can rotate respectively for covering a thick document, whereby the revolution of the main lid can make itself to remain substantially parallel with a platen in order to accommodate various thicknesses of documents for image processing.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

An embodiment of the present invention, which is applied to a cover assembly of scanning apparatus, will now be described with reference to the accompanying drawings. It should be known that the cover assembly also could be applied to the other apparatus in an image processing system, such as copiers.

Figure 1A:
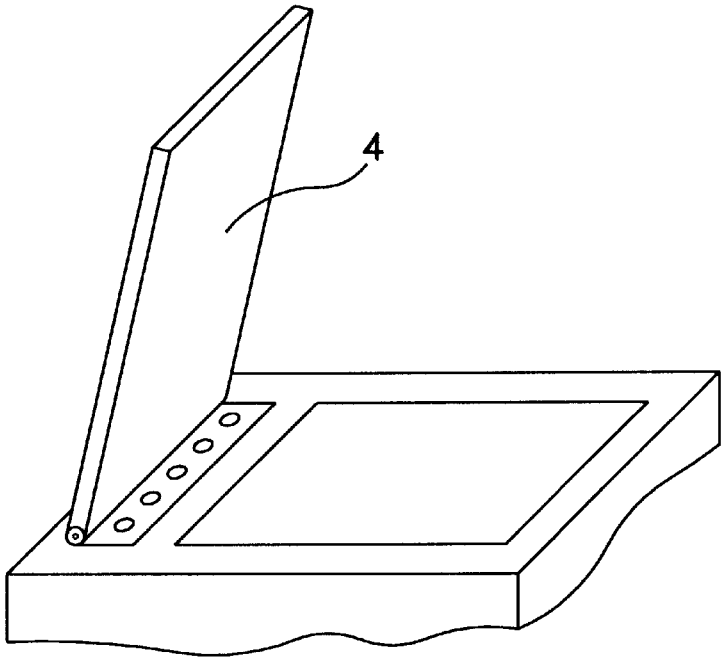
FIG.1A (PRIOR ART)
FIG. 1A is a perspective view of the upper portion of a prior art scanning apparatus showing the rigid cover member in an open position.
Figure 1B:
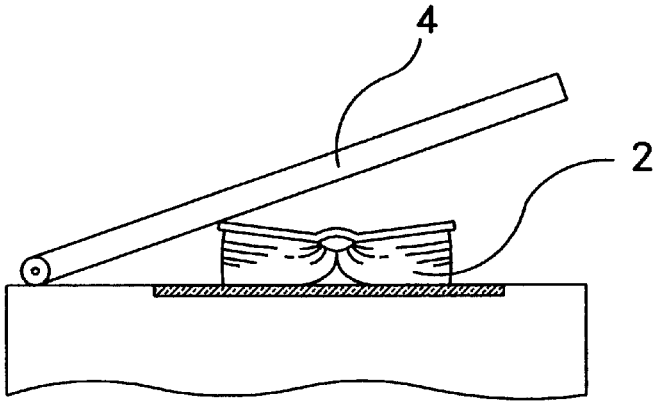
FIG.1B (PRIOR ART)
FIG. 1B is a cross-sectional view of the upper portion of the prior art scanning apparatus of FIG. 1A showing the rigid cover member in a closed position.
Figure 2:
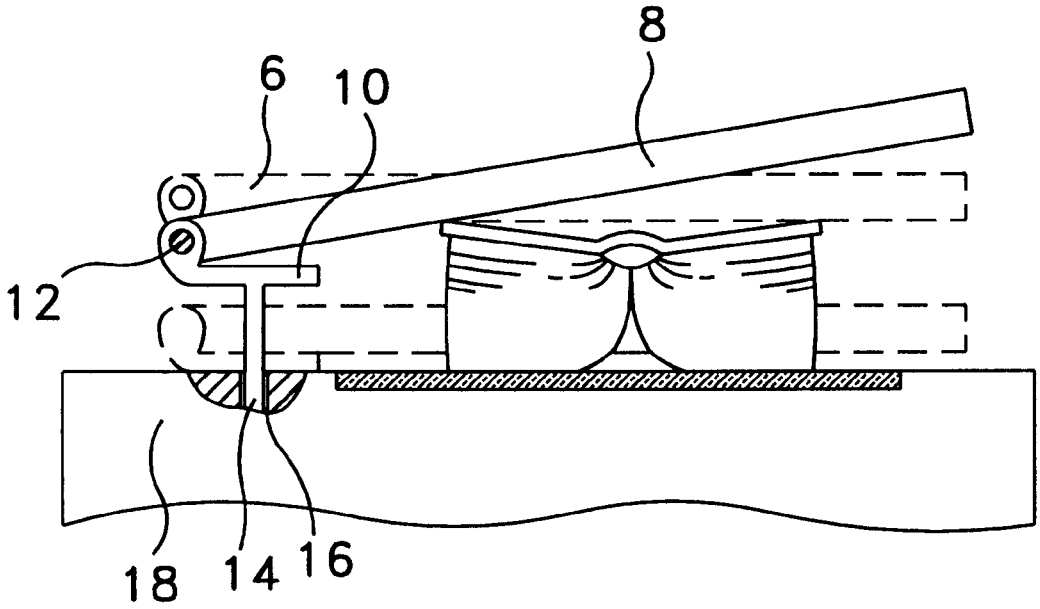
FIG.2 (PRIOR ART)
FIG. 2 is a cross sectional front elevational view of a second type prior art scanning apparatus, illustrating an intermediate stage of the cover assembly operation, with the initial and final stage indicated in phantom.
Figure 3:
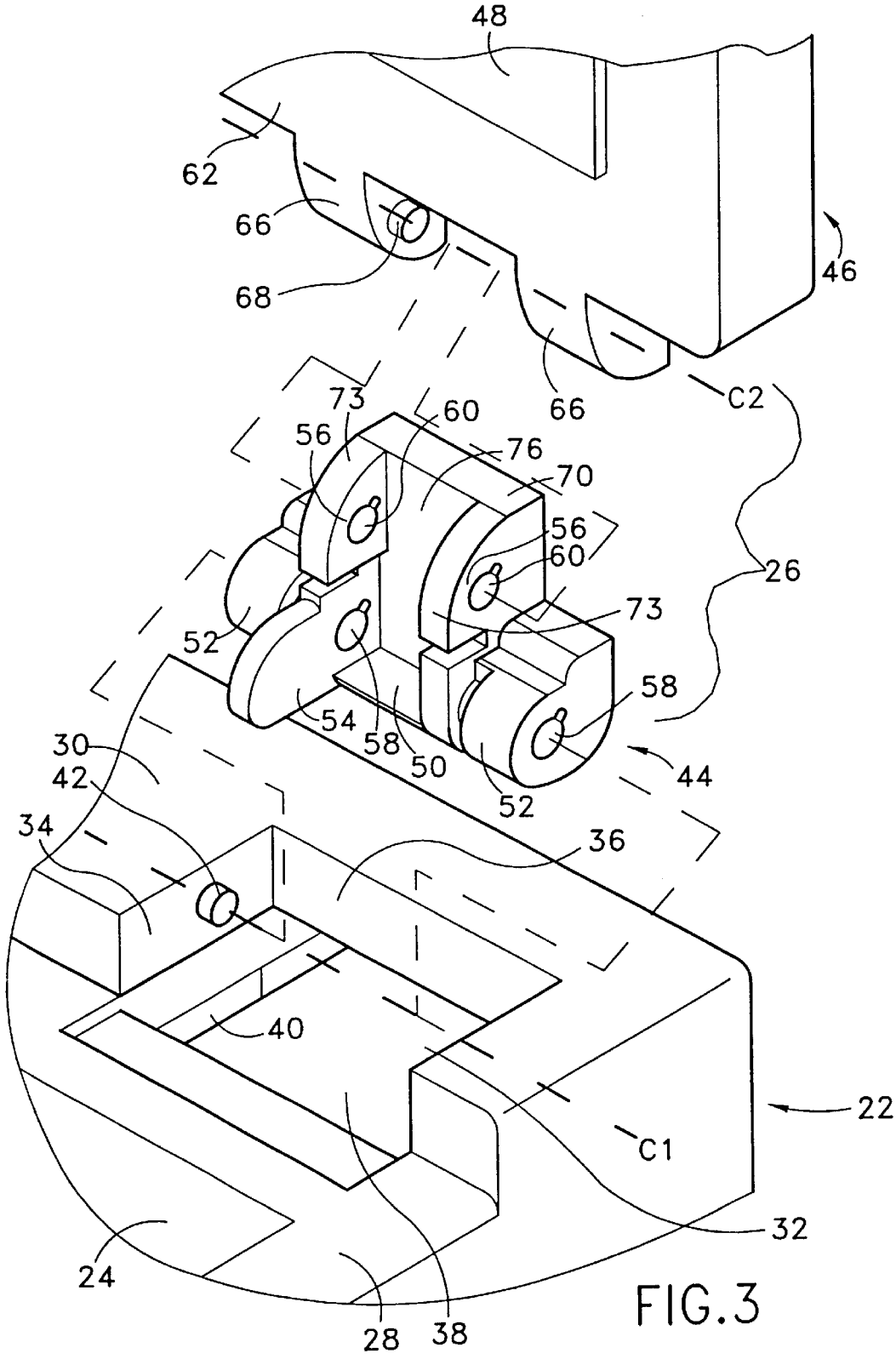
FIG. 3 is a perspective view of a housing body, a articulating link, and a rigid cover member of image processing system showing the constructions.
Figure 4:
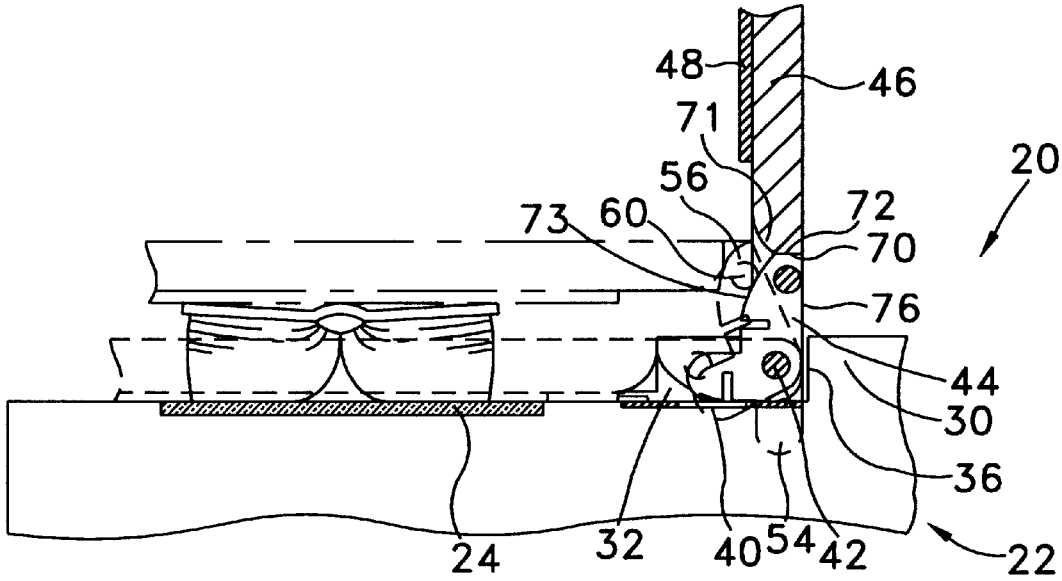
FIG. 4 is a greatly enlarged, fragmentary, cross sectional front elevational view of the image processing system, illustrating an intermediate stage of the cover assembly operation, with the initial and final stage indicated in phantom.

Referring to FIGS. 3 and 4, there is shown a portion of a scanning apparatus 20 comprising a housing body 22, a document setting platen 24, and a cover assembly 26.

The housing body 22 includes a substantially flat top frame 28 and an upwardly projecting region 30 that extends along the rear margin of the housing body 22. Near the ends of the projecting region 30, are formed recessed regions 32. Each of the recessed regions 32 incorporates side walls 34, a rear wall 36, and a bottom wall 38 having an opening 40.

As is shown in FIG. 3, two first pivots 42 are formed on two side walls 34 of each recessed region 32 respectively.

The document setting platen 24 is disposed within the top frame 28 of the housing body 22 and forms a contiguous substantially level surface flush with the top frame 28. The platen 24 is manufactured of glass or other transparent material. The platen 24 receives documents to be scanned and its optically transparent nature allows scanned information to be exposed through it to image pick-up device disposed within the housing body 22.

The cover assembly 26 comprises two articulating links 44, a rigid cover member 46, and a document retaining pad 48.

The articulating links 44, seen more clearly in FIG. 3, are of unitary constructions and comprises a U-shaped portion 50, two side projecting portions 52, and a starter 54. The length of the articulating link 44 may be any desired dimension to accommodate the thickness of document. However, by referring to FIG. 3, it is clear that articulating links 44 is an unbending structure.

The U-shaped portion 50 has two side walls 56. On one end of the U-shaped portion 50, two side projecting portions 52 protrude outward from the outer surfaces of side walls 56. The side projecting portions 52 have two first holes 58 respectively. An opposed end of the U-shaped portion 50 is formed two second holes 60.

Near one side projecting portion 52, the starter 54 extends from the side walls 56. The starter 54 aids in the starting of the scanning work.

The first pivots 42 are telescoped into the first holes 58 causing the articulating links 44 pivotally mounted to the housing body 22.

The rigid cover member 46 incorporates a substantially flat platen-covering portion 62. The platen-covering portion 62 is opaque and serves as a good reflective plate, whereby to provide a background for the document being scanned. The platen-covering portion 62 is of a size to cover the top frame 28. A rear wall of platen-covering portion 62 forms two pairs of horizontally extending legs 66. Two pairs of horizontally extending legs 66 are formed on right-hand side and left-hand side of the rear wall respectively. The inside walls of each pair of horizontally extending legs 66 have two second pivots 68 respectively.

The second pivots 68 of the legs 66 are telescoped into the second holes 60 of the articulating links 44 causing the articulating links 44 pivotally mounted to the rigid cover member 46.

An opposite connecting method, such as two projecting pivots on each link are telescoped into two holes on each pair of legs of the cover member could be used without departing from the spirit of the present invention.

In this embodiment, two links, unbending structure pivotally connect the rigid cover member with the housing body, but it is appreciated that the number of links could be increased for linking.

The document-retaining pad 48 is manufactured of a resilient foamed material and is mounted to the underside of a cover member 46 and contacts the platen 24 when the cover assembly 46 is in a closed position. The document-retaining pad 48 prevents the document to be scanned from sliding while in contact with the platen 24.

Figure 5:
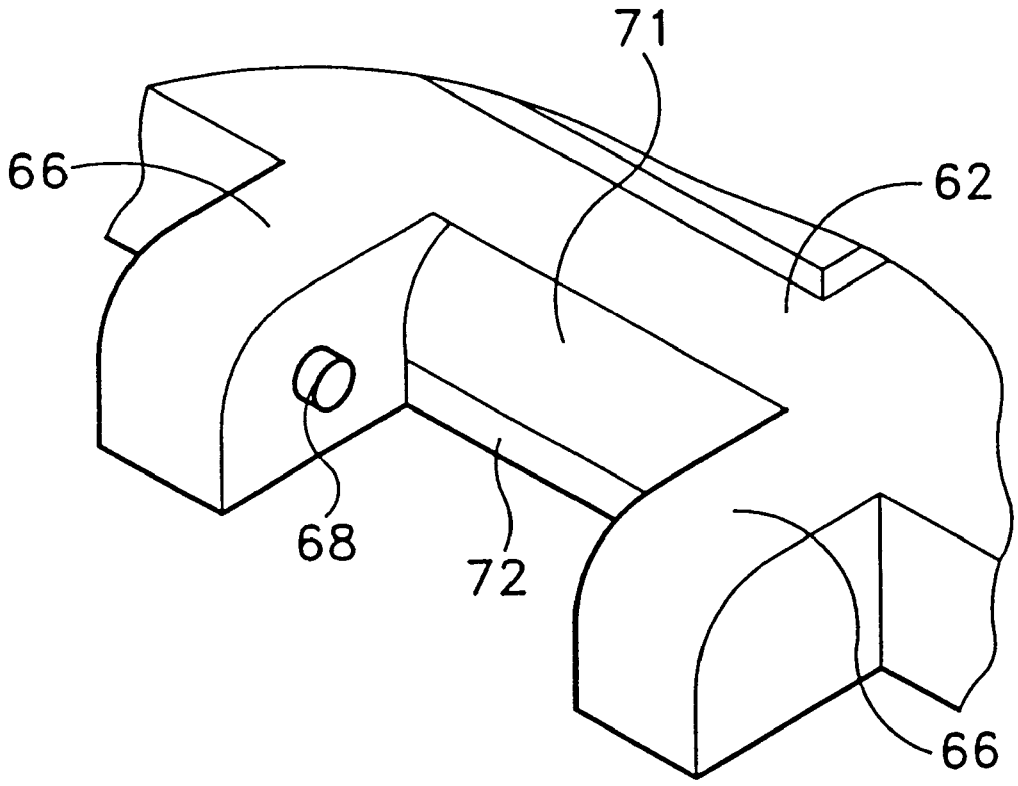
FIG. 5 is a greatly enlarged, fragmentary, perspective view of the rigid cover member of image processing system showing the construction.
Figure 6:
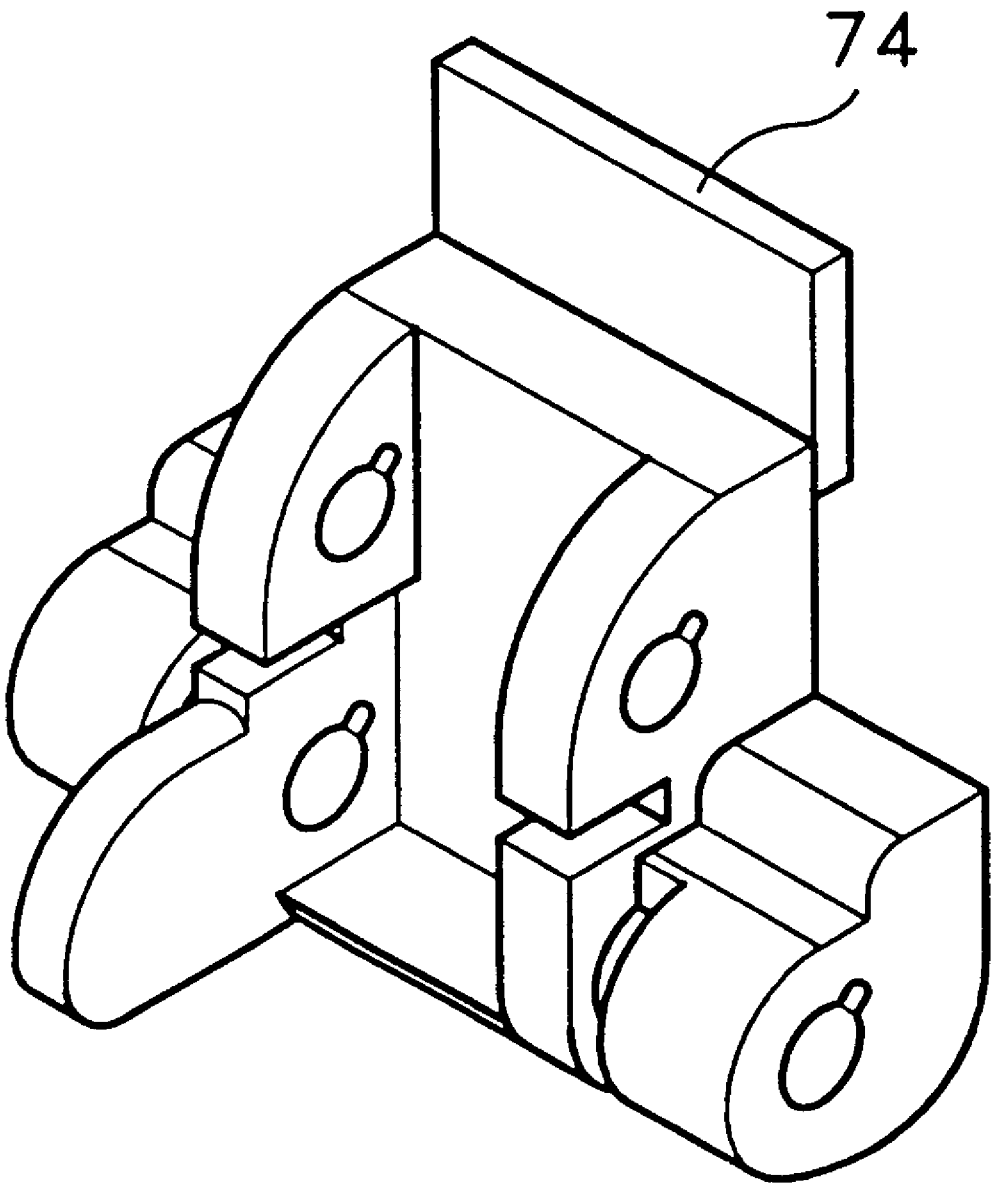
FIG. 6 is a perspective view of a articulating link showing the shape and position of a stopper.

When the document is to be scanned, the cover member 46 is opened by an upward clockwise movement so that the cover member 46 rotates around the first axis C1 defined by the first pivots 42 and not the second axis C2 defined by the second pivots 68. As is shown in FIG.5, the engagement of top portions 70 of the articulating links 44 and flat areas 72 on the rear wall of the cover member 46 between two legs 66 preventing rotation of cover member 46 about the second axis C2. FIG.6 shown one of the other stopper means, such as a projecting portion 74 formed on the link near the second pivots could be adapted in stopping the cover member from pivoting toward the back of the link.

In the embodiment shown, when the cover member 46 is rotated about 90 degrees from the closed position to the open position, the back wall 76 of the articulating link 44 abuts upon the rear wall 36 of the recessed region 32, thereby limiting further rotation of the cover member 46. The cover member 46 is shown in its fully raised position in FIG. 4.

Then the document is placed on the platen 24. It is possible also to raise the cover member 46 sufficiently high enough to allow the document to be placed on the platen 24 but not in its fully raised position.

With the document in place, the cover member 46 is lowered to contact it. When user exerts a downward pressure on the cover member 46, it revolves about the second axis C2 from its fully raised position. The revolving action of the cover member 46 causes the articulating link 44 to revolve counterclockwise about the first axis C1 thereby causing the starter 54 to enter the opening 40. As soon as the starter 54 is detected by a sensor included in the housing body 22, the scanning apparatus has to get ready for scanning.

Articulated movement thus enables the cover member 46 to assume a parallel disposition relative to the platen 24 and engages the back of the document. The cover member 46 will exert a uniform downward pressure on the document, helping to keep it in place during the scanning cycle, urging its exposed pages into close contact with the platen 24. It should be noted that the front edge of the cover member 46 is still substantially in alignment with the front margin of the platen 24. When the scanning work is finished, the cover member 46 is raised to sufficiently high enough to allow the document to be removed. Then the cover member 46 is pivotally lowered by exerting a downward pressure on it, thereby causing the articulating link 44 to pivot counterclockwise about the first axis C1.

When the cover member 46 is pivoted downward toward engagement with the platen 24, curved areas 71 of the cover member 46 will rollingly contact with curved portions 73 of the articulating links 44 until the flat areas 72 of the cover member 46 is in engagement with the top portions 70 of the articulating links 44. At the same time, the cover member 46 is engaged against the platen 24 and in its initial closed position.

Figure 7:
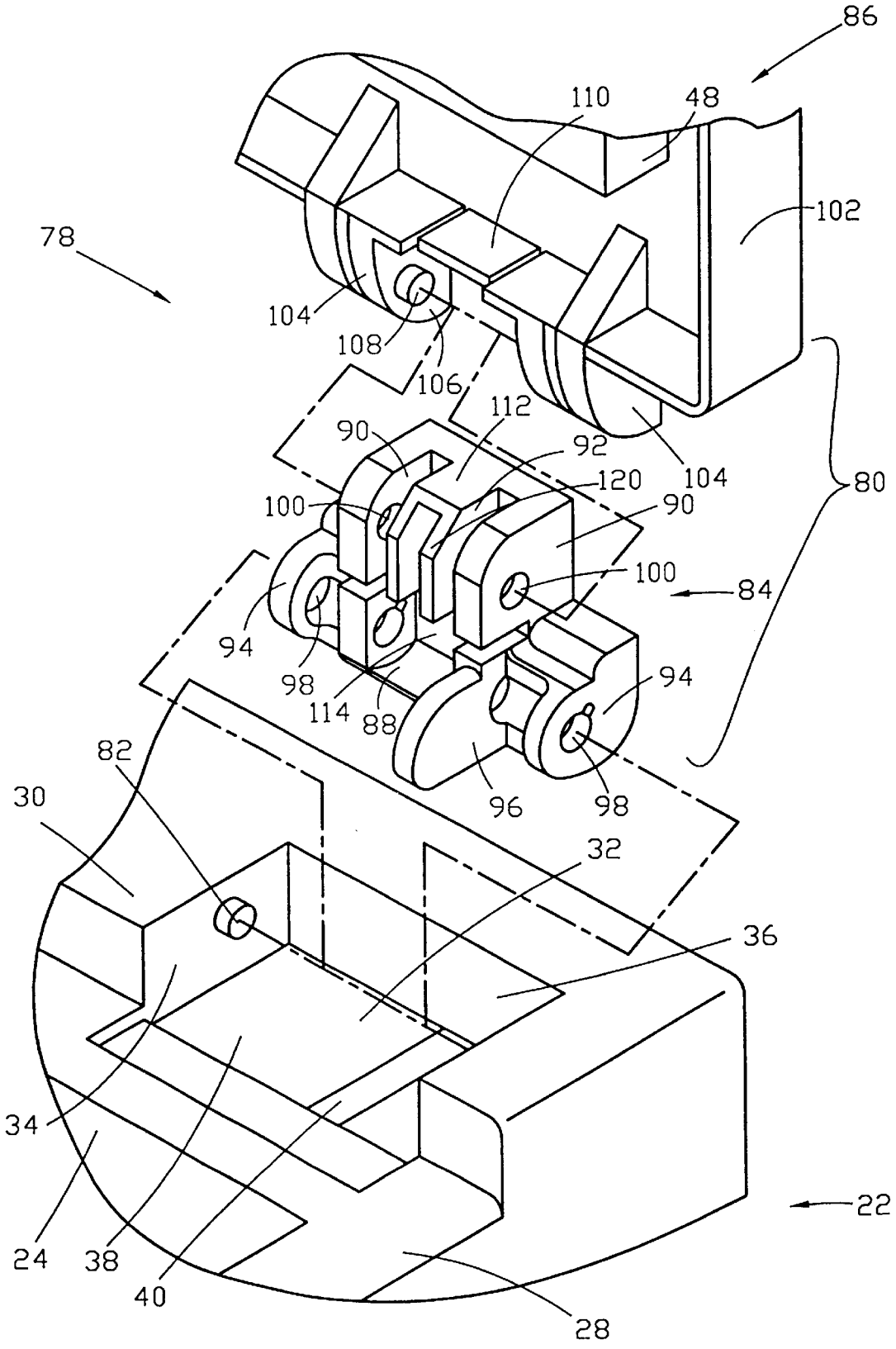
FIG. 7 is a perspective view of a different embodiment a articulating link, a main lid and a housing body similar to that shown in FIG.3.

FIG. 7 illustrates an alternate embodiment of the present invention. FIG. 7 also illustrates a portion of a scanning apparatus 78 comprising a housing body 22, a document setting platen 24, and a cover assembly 80. The housing body 22 incorporates a top frame 28 and an upwardly projecting region 30 extended along the rear margin of the housing body 22. There are two recessed regions 32 formed near the ends of the projecting region 30, and each recessed region 32 comprises side walls 34, a rear wall 36, and a bottom wall 38 having an opening 40. Two third pivots 82 are formed on two side walls 34 of each recessed region 32 respectively. The document setting platen 24 is disposed within the top frame 28 of the housing body 22 and forms a contiguous substantially flat surface together with the top frame 28.

The cover assembly 80 comprises two articulating links 84, a rigid cover member 86, and a document retaining pad 48. Certainly, as discussed in previous embodiment, articulating links 84 can be replaced by any unbending structure.

Each articulating link 84 incorporates a U-shaped portion 88 that has two side walls 90, a first rib 92, two side projecting portions 94 and a starter 96. The first rib 92 is formed between two side walls 90 and on one end of the U-shaped portion 88, two side projecting portions 94 that have two third holes 98 respectively protrude outward from outer surfaces of two side walls 90. An opposed end of the U-shaped portion 88 is formed two fourth holes 100. Near one of the side projecting portions 94, the starter 96 extends from one of the side walls 90. The third pivots 82 are telescoped into the third holes 98 causing the articulating links 84 pivotally mounted to the recessed regions 32.

The rigid cover member 86 incorporates a main lid 102 that is opaque to provide a background for the document being scanned and is of a size to cover the top frame 28. There are two pairs of horizontally extending legs 104 on the rear wall of the main lid 102. Two inside walls 106 of each pair of the horizontally extending legs 104 have two fourth pivots 108 respectively. Between each pair of the horizontally extending legs 104, a second rib 110 is formed on the main lid 102. The fourth pivots 108 are telescoped into the fourth holes 100 causing the articulating links 84 pivotally mounted to the rigid cover member 86. An opposite connecting method, such as projecting pivots on the links are telescoped into holes on the legs of the cover member could be used without departing from the spirit of the present invention.

The document-retaining pad 48 is manufactured of a resilient foamed material and is mounted to the underside of a cover member 86, it can prevent the document to be scanned from sliding while in contact with the platen 24.

Figure 8A:
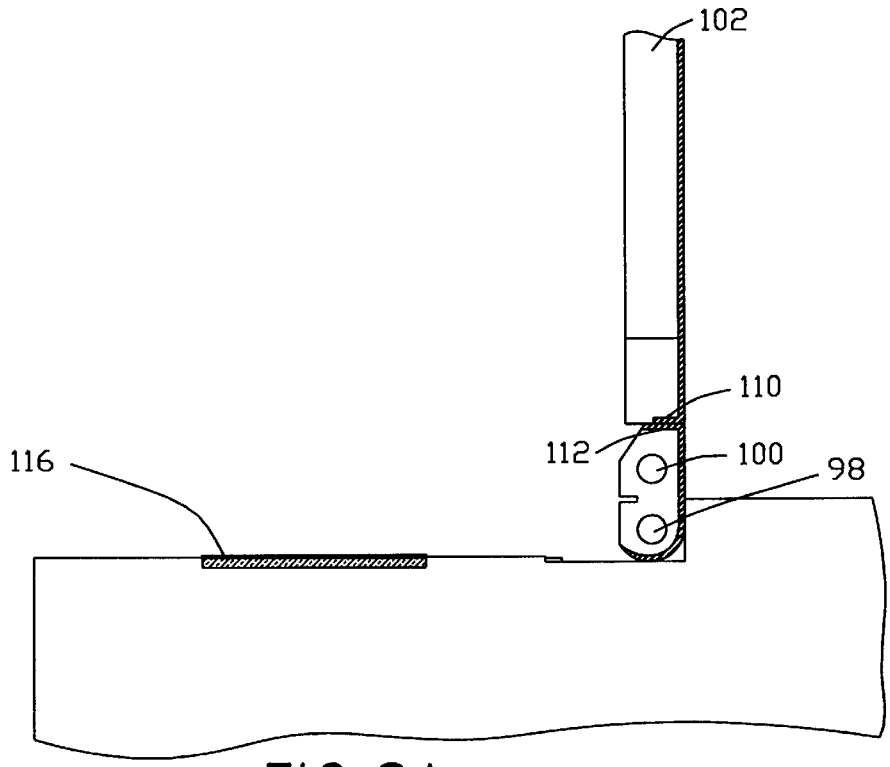
FIG. 8A is a greatly enlarged, fragmentary, cross sectional front elevational view of the image processing system shown in FIG. 6, in its opened position.
Figure 8B:
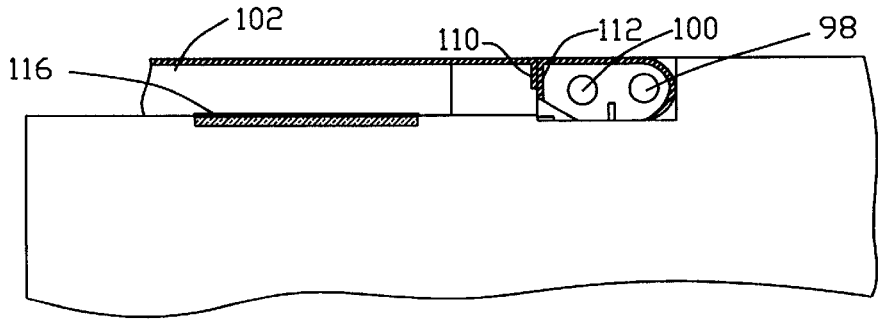
FIG. 8B is a greatly enlarged, fragmentary, cross sectional front elevational view of the image processing system shown in FIG. 6, in its closed thin-document scanning position.

As illustrated in FIG. 8A and FIG. 8B, when a thin document 116 is to be scanned, the user grasps the free end of the rigid cover member 86 and exerts an upward force. This causes two second ribs 110 of the main lid 102 engage with two tops 112 of first ribs 92 of the articulating links 84 so that the cover member 86 only pivots clockwise about the third pivots 82 and not pivot about the fourth pivots 108.

When the cover member 86 is rotated about 90 degrees from the closed position to the open position, two back walls 114 of the articulating links 84 abuts upon the rear wall 36 of the recessed region 32, thereby limiting further rotation of the cover member 86. The user puts the thin document 116 on the platen 24 when the cover member 86 is in its fully raised position or enough highness. Then the cover member 86 is lowered by a downward force to contact the thin document 116. The downward force causes two second ribs 110 of the main lid 102 still engage with two tops 112 of first ribs 92 of the articulating links 84, so the cover member 86 and the articulating links 84 together revolve counterclockwise about the third pivots 82 until the cover member 86 contacts the thin document 116, the starter 96 enters the opening 40 at the same time.

Figure 9A:
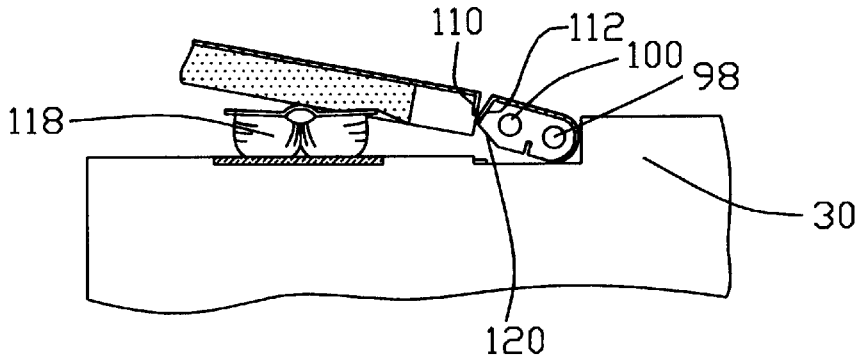
FIG. 9A is a greatly enlarged, fragmentary, cross sectional front elevational view of the image processing system shown in FIG. 6, in the position of contacting thick-document.
Figure 9B:
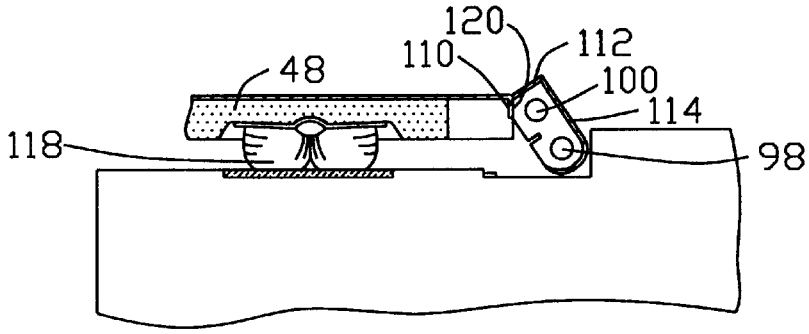
FIG. 9B is a greatly enlarged, fragmentary, cross sectional front elevational view of the image processing system shown in FIG. 6, in its closed thick-document scanning position.

As illustrated in FIG. 9A and FIG. 9B, when a thick document 118 is to be scanned, the cover member 86 is pivoted upward from its closed position until the document can be placed on the platen 24. The cover member 86 is then pivotally lowered until it is in contact with the book. When the cover member 86 contacts with the thick document 118, the second rib 110 of the main lid 102 will be curved by the weight of the cover member 86. The user then exerts a downward force on the free end of the cover member 86 until the cover member 86 is substantially parallel with the platen 24. This force causes the cover member 86 to pivot in a counterclockwise direction about the fourth pivots 108 and brings the second rib 110 that is a little curved into contact with a inclined plane 120 of the first rib 92.

When the scanning work is finished, the cover member 86 is raised to sufficiently high enough to allow the thick document 118 to be removed. The force that raises the cover member 86 causes the first ribs 92 to slide out of the inclined plane 120 of the first ribs 92 and to contact with the tops 112 of the first ribs 92. Then the cover member 86 is lowered to cover the platen 24.

While the invention has been described in terms of what are presently considered to be the most practical and preferred embodiments, it is to be understood that the invention need not be limited to the disclosed embodiment. On the contrary, it is intended to cover various modifications and similar arrangements included within the scope of the appended claims which are to be accorded with the broadest interpretation so as to encompass all such modifications and similar structures.

What is claimed is:

1. A cover assembly for an image processing system having a housing body and a platen surface, said cover assembly comprising:

(a) a cover member having a substantially flat portion of a size to overlie said platen surface; and (b) an unbending structure having one end pivotally mounted to said cover member and having a second end pivotally mounted to said housing body, wherein said unbending structure comprises at least one stopper near said second end for limiting said cover member to pivot toward the back of said unbending structure, said unbending structure being used to link said cover member and said housing body, said unbending structure also being used to enable said cover member to remain substantially parallel with said platen surface in order to accommodate various thicknesses of documents for image processing.

2. A cover assembly for an image processing system having a housing body and a platen surface, said cover assembly comprising:

(a) a unitary cover member having a substantially flat portion of a size to overlie at least said platen surface, one end of said flat portion forming a plural pairs of extending legs; and (b) a plurality of unitary links, having an amount equal to total pairs of said extending legs, each said link having one end pivotally mounted to one pair of said extending legs on their interiors and having the other end pivotally mounted to one of a plurality of recessed regions formed in said housing body and having an amount equal to links, wherein said links enable said cover member to remain substantially parallel with said platen surface in order to accommodate various thicknesses of documents for image processing.

3. The cover assembly of claim 2, wherein each said link comprises two ends, where one end of any specific said link is mounted to one pair of said extending legs by telescoping two second pivots formed on interiors of said extending legs into two second holes formed on the one end of said link, the other end of said specific link is mounted to one of said recessed regions by telescoping two first pivots formed on sides walls of said recessed regions into two first holes formed on the end of said specific link.

4. The cover assembly of claim 3, wherein the combination of said links and said unitary cover member pivot about said first pivots and said unitary cover member pivots about said second pivots, whereby compound pivoting about said first pivots and said second pivots allows said cover member to remain substantially parallel with said platen surface in order to accommodate various thicknesses of documents for image processing.

5. The cover assembly of claim 2, wherein each of said links comprises at least one stopper near two second pivots, for stopping said cover member from pivoting toward the back of said links.

6. The cover assembly of claim 2, wherein at least one starter formed on said links, whereby cooperation of said starter and a sensor included in said housing body allows said image processing system to get ready for image processing.

7. The cover assembly of claim 2, wherein said links are formed of a synthetic resin.

8. A cover assembly for an image processing system having a housing body and a platen surface, said cover assembly comprising:

(a) a unitary cover member having a main lid of a size to overlie at least said platen surface, one wall of said main lid forming a plural pairs of extending legs; and (b) a plurality of unitary links, having the amount equals to total pairs of said extending legs, each said link having a first rib and said main lid having a second rib, one end of each said link pivotally mounted to one pair of said extending legs on their interiors and the other end pivotally mounted to one of a plurality of recessed regions formed in said housing body and having the amount equals to links, wherein said links enables said cover member to remain substantially parallel with said platen surface in order to accommodate various thicknesses of documents for image processing.

9. The cover assembly of claim 8, wherein each said link has two ends, one end pivotally mounted to one pair of said extending legs by telescoping two second pivots formed on interiors of said extending legs into two second holes formed on the one end of said link and the other end pivotally mounted to one of said recessed regions by telescoping two first pivots formed on sides walls of the corresponding said recessed region into two first holes formed on the end.

10. The cover assembly of claim 9, wherein the combination of said links and said unitary cover member pivots about third pivots for covering a thin document and where said unitary cover member can pivot about fourth pivots for covering a thick document, whereby the revolution of said cover member allows said cover member to remain substantially parallel with said platen surface in order to accommodate various thicknesses of documents for image processing.

11. The cover assembly of claim 10, wherein said unitary cover member only pivots about the third pivots for covering said thin document by the engagement of said second rib of said main lid and a top plane of said first rib.

12. The cover assembly of claim 10, wherein said unitary cover member can pivot about said fourth pivots for covering said thick document by a downward force and deformation of said second rib of said main lid.

* * * * *